US006705014B2

(12) United States Patent
Park

(10) Patent No.: US 6,705,014 B2
(45) Date of Patent: Mar. 16, 2004

(54) NAIL CLIPPER

(76) Inventor: Kyunghan Park, #21-52, Yokchon-Idong, Eunpyoung-ku, Seoul (KR)

( * ) Notice: Subject to any disclaimer, the term of this patent is extended or adjusted under 35 U.S.C. 154(b) by 0 days.

(21) Appl. No.: 10/011,576

(22) Filed: Dec. 3, 2001

(65) Prior Publication Data

US 2002/0092172 A1 Jul. 18, 2002

(30) Foreign Application Priority Data

Dec. 1, 2000 (KR) ..... 10-2000-72494
Jun. 16, 2001 (KR) ..... 20-2001-18053

(51) Int. Cl.[7] ..... B26B 17/00
(52) U.S. Cl. ..... 30/28; 30/26; 30/175; 30/123; 7/162
(58) Field of Search ..... 30/28, 175, 123, 30/142, 145, 501, 26; 7/162

(56) References Cited

U.S. PATENT DOCUMENTS 994,119 A * 6/1911 Browning ..... 30/28
2,839,827 A * 6/1958 David ..... 30/28
3,261,094 A * 7/1966 Bliss ..... 30/143
4,017,923 A * 4/1977 Schantz ..... 7/162
5,331,739 A * 7/1994 Basangy ..... 30/28
5,557,849 A * 9/1996 Lee et al. ..... 30/29
5,819,750 A * 10/1998 Moyer ..... 131/175

* cited by examiner

*Primary Examiner*—Allan N. Shoap
*Assistant Examiner*—John Windmuller
(74) *Attorney, Agent, or Firm*—Sheridan Ross PC

(57) ABSTRACT

A nail clipper, of which a fixed body is operated with a lever, is folded by a board spring, and unfolding angle between the fixing body and the lever is maintained in certain angle, so that the fingernail can be cut safely, at the same time, when the present invention is not used, a putting green is renewed by a cover board, which eliminates the angle, covering the said lever that maintains the angle by board spring.

1 Claim, 3 Drawing Sheets

NAIL CLIPPER

BACKGROUND OF THE INVENTION

1. Field of Invention

The present invention relates to a nail clipper and more particularly to a nail clipper that a fixed body is operated engaged with a lever, which is folded by a board spring. The unfolding angle between the fixing body and the lever is maintained in certain angle, so that the fingernail can be cut safely. On the other hand, when the present invention is not used, a putting green is renewed by a cover board, which eliminates the angle, covering the said lever that maintains the angle by board spring. Therefore, the present invention has a function of a plow as well as a nail clipper.

As one side of the board spring (30) of the prior invention is fixed on the end of the fixed body (10) according to FIG. 4 and FIG. 5, the board spring (30) is placed inside of the fixed body (10) as shown in the FIG. 2. The lever (20) is combined with the fixed body (10) inside and folded using a pin (40), while the cover board (70) presses the lever that maintains the angle as shown in FIG. 7.

However, the lever (20) that is combined with the fixed body (10) can be set apart from the fixed body (10) continuously, so the angle of setting apart is too broad, which makes a user damage his skin beneath a toenail carelessly.

Furthermore, although a file is formed on the cover board (70), this kind of cover board (70) is only to press the lever (20) that maintains the angle, so another usage is required.

2. Discussion of Related Art

Thus, in order to solve the above-mentioned problem, a protrusion part is formed on the back of the cutting edge, and placed on the lever, which enables for cutting edges to be set apart and maintained in a certain angle, and then the cover board is cut to form as 'U', so that it can be used for renewing the green of golf course.

BRIEF DESCRIPTION OF THE ATTACHED DRAWINGS

DETAILED DESCRIPTION OF PREFERRED EMBODIMENT

The following is the detailed description of the most desirable embodiment of the present invention. The most desirable embodiment of this invention will be described in detail according to the attached drawings on the following and the same reference number will be used to mean the same drawing elements regardless of different drawings.

Figure 1:
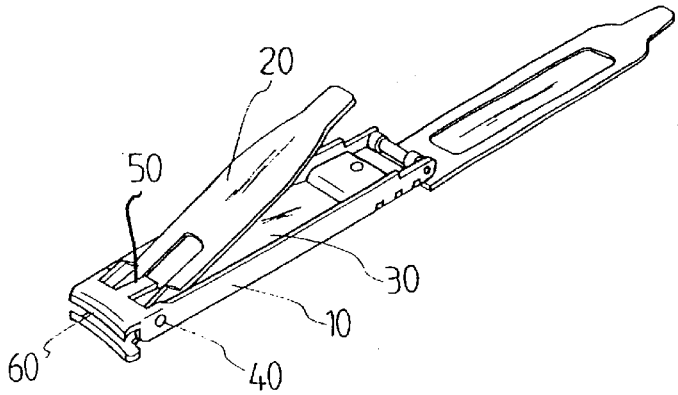
FIG. 1 is a perspective view according to an embodiment of a nail clipper.
Figure 2:
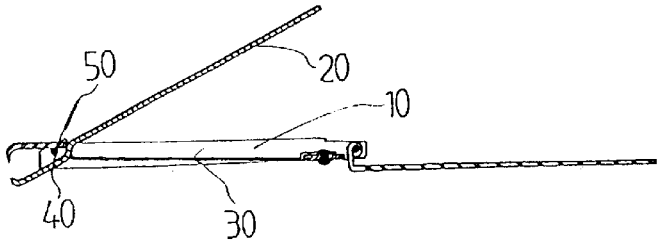
FIG. 2 is a lateral view showing according to an embodiment of a nail clipper.
Figure 3:
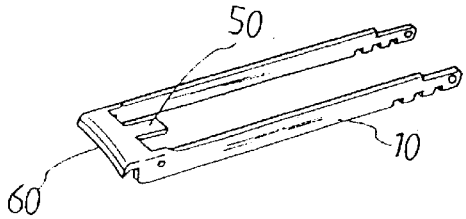
FIG. 3 is a perspective view showing the lever of the nail clipper.
Figure 4:
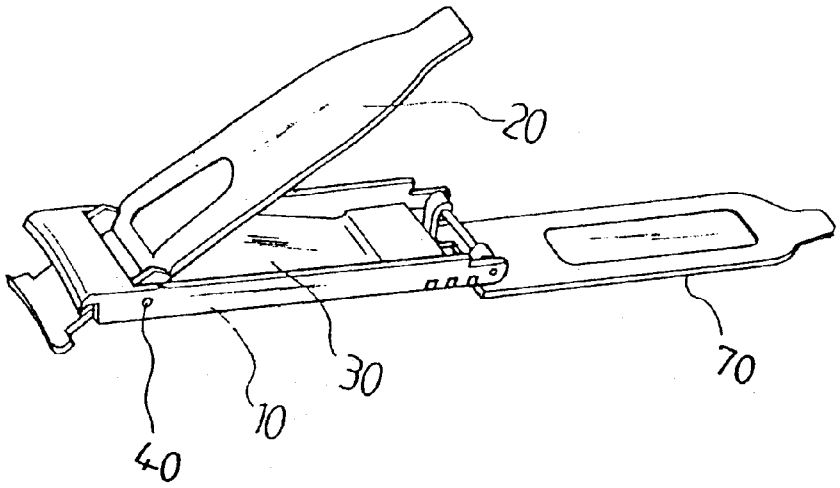
FIG. 4 PRIOR ART
FIG. 4 is a perspective view according to an embodiment of the prior art.
Figure 5:
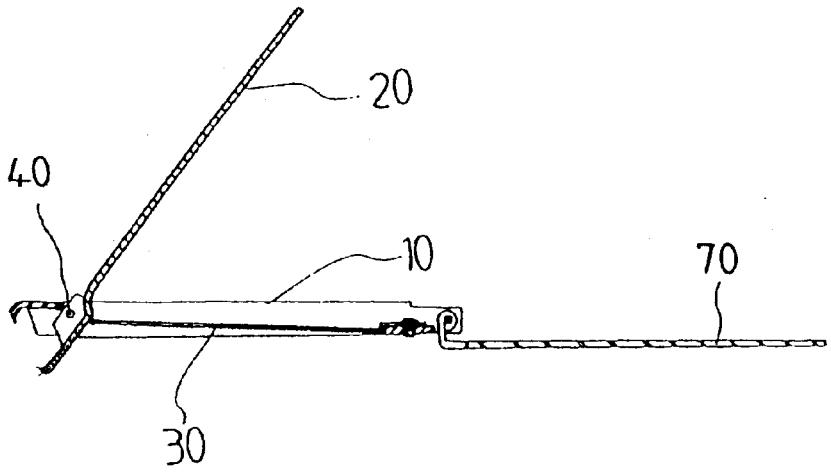
FIG. 5 PRIOR ART
FIG. 5 is a lateral view showing according to an embodiment of the prior art.
Figure 6:
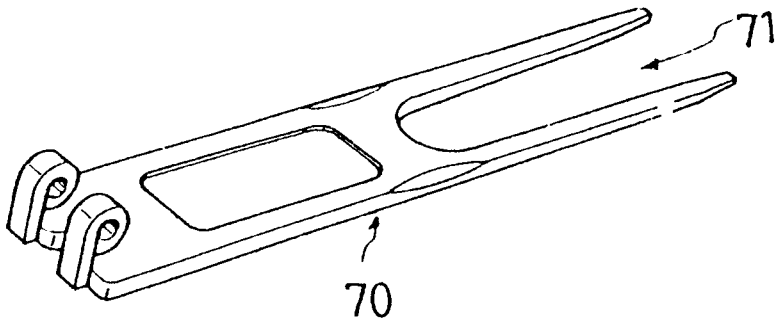
FIG. 6 is a perspective view according to an embodiment of the cover board.
Figure 7:
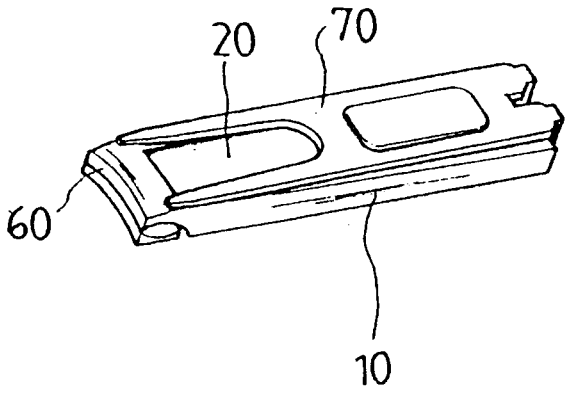
FIG. 7 is a perspective view showing that the cover board folds the lever.

For the embodiment of the present invention is described as shown in the FIG. 1, the lever (20) is inserted into the fixed body (10), combined and folded by the pin (40). The forward part of the board spring (30), which is fixed on the end of the fixed body (10), is placed on the back of the lever (20), so that the lever (20), which is pressed by maintaining a regular angle between the fixed body (10) and the lever (20), works continuously with the elasticity of the board spring (30). The protrusion part (50) is formed from the forward part of the fixed body (10) to the inside and placed on the forward part of the lever (20), so that the lever (20) maintains the angle in regular.

This kind of protrusion part (50) can adjust the opening angle of according to the length and the angle of protruding.

In addition, the cutting part of 'U' (71) is formed on the forward part of the cover board (70) that presses the lever (20) and folded for keeping, so that it can be used as a mini-plow for renewing the green of golf course after swing.

Thus, when the lever (20) is pressed by the board spring (30) that is fixed on the end of the fixed body (10), the lever (20) works continuously by the elasticity of the board spring (30). The protrusion part (50) of the fixed body (10) maintains the opening angle of the lever (20) and it can be used as a mini-plow for renewing the green of golf course after swing.

What is claimed is:

1. A nail clipper comprising:

a fixed body having a cutting end, a board spring located within the fixed body, a lever having a cutting end, wherein the lever is hingedly attached to the fixed body by a pin, wherein the lever is positioned on the board spring to angle away from the fixed body and hold the cutting end of the lever below the cutting end of the fixed body and to move the cutting end of the lever against the cutting end of the fixed body when the lever is depressed against the board spring, a cover board that is pivotally attached to said body at another end thereof distal from said cutting end of said body, wherein said cover board covers and depresses the lever and has a 'U'-shaped indentation that can function to renew the green of a golf course after a golf swing, said indentation being closer to said cutting end than to said other end when covering said lever, and a protrusion formed on the inside forward part of the fixed body which contacts the lever to hold the lever at a fixed angle from the fixed body.

* * * * *